US005415332A

United States Patent [19]

Kliot

[11] Patent Number: 5,415,332

[45] Date of Patent: May 16, 1995

[54] MULTIMODE TRAVELING BAG

[76] Inventor: Eugene Kliot, 145 W. 67th St., Suite 21H, New York, N.Y. 10023

[21] Appl. No.: 201,554

[22] Filed: Feb. 24, 1994

[51] Int. Cl.[6] ..... A45F 5/00

[52] U.S. Cl. ..... 224/153; 224/205; 224/258; 150/108; 150/106; 294/141; 383/15; 383/4

[58] Field of Search ..... 224/151, 153, 202, 205, 224/206, 208, 209, 257–259, 264, 901; 294/141, 142; 150/106, 108; 383/4, 8, 13, 15

[56] References Cited

U.S. PATENT DOCUMENTS

| | | | |
|---|---|---|---|
| 447,669 | 3/1891 | Dwyer | 224/153 |
| 2,262,313 | 11/1941 | Clappier | 224/209 |
| 2,846,699 | 8/1958 | Watson | 224/151 X |
| 2,902,195 | 9/1959 | Marshall | 224/202 X |
| 3,346,155 | 10/1967 | Oechesle | 224/205 |
| 4,194,602 | 3/1980 | Allen | 224/202 |
| 4,424,841 | 1/1984 | Smith | 224/151 X |
| 4,763,763 | 8/1988 | Sadow | 224/151 X |
| 5,211,716 | 5/1993 | Tobias | 150/108 X |

FOREIGN PATENT DOCUMENTS

| | | | |
|---|---|---|---|
| 0494731 | 7/1950 | Belgium | 150/108 |
| 0080550 | 8/1952 | Norway | 224/153 |

*Primary Examiner*—J. Casimer Jacyna
*Attorney, Agent, or Firm*—James A. Quinton; Frank Frisenda, Jr.

[57] ABSTRACT

According to the invention a multimode traveling bag is provided which can be carried as a hand carrying bag, a back pack, shoulder bag or over the head bag. The invention provides these multimode operations while limiting the number of handles and straps. Preferably a single handle and strap are provided which are neatly positioned along the body of the bag when not in use. The traveling bag desirably has a single strap affixed at each end of the strap to the left and right side of the traveling bag. The strap should be of sufficient length so that the attached strap can be placed over the head of the user when the user desires to carry the bag over his head and support the bag by the opposite shoulder.

15 Claims, 5 Drawing Sheets

MULTIMODE TRAVELING BAG

BACKGROUND OF THE INVENTION

1. Field of the Invention

The present invention relates to the field of traveling bags. In particular, the invention relates to multimode traveling bag that can be used as a hand carrying bag, back pack, or shoulder bag.

2. Description of the Prior Art

Traveling bags have been long used in the prior art. In order to allow the user to carry the traveling bag in a variety of different ways, numerous straps and handles have been added to the bags. Multiple straps have been added at various points on the traveling bag to allow the user to variously carry the bag in one hand, over the shoulder or as a back pack. However, the addition of so many different straps and handles at multiple locations on the bag have resulted in a cluttered disorganized looking bag. In addition, the proliferation of straps and handles can be caught on projecting objects, in doors or escalators. See, for example, U.S. Pat. Nos. 954,840 (Wiedmann), 294,622 (Honinger), 4,856,570 (Rushing), 4,566,130 (Coates). Efforts have been made to provide carrying bags with multiple use straps. See, U.S. Pat. Nos. 4,273,274 (Freistadt), 3,802,613 (Droeger). However, there is still a need for versatile traveling bag that can be carried in a variety of different ways.

SUMMARY OF THE INVENTION

The present invention is directed to an improved traveling bag. According to the invention, a traveling bag which has multiple modes by which it can be carried by the user is provided.

It is an object of the invention to provide a traveling bag which can be carried as a hand carrying bag, a shoulder bag, or a back pack at the option of the user.

It is an object of the invention to provide a traveling bag which has a minimal number of straps and yet at the same time can be used as a shoulder bag, back pack or handbag.

It is an object of the invention to provide a traveling bag which is adapted for multiple carrying modes.

Other further objects will become evident by referring to the appended specifications and drawings.

According to the invention a multimode traveling bag is provided which can be carried as a hand carrying bag, a back pack, shoulder bag or over the head bag. The invention provides multimode operations while limiting the number of handles and straps preferably to a single handle and strap. In one aspect of the invention, a traveling bag is provided which has a single strap affixed to the left and right side of the traveling bag. The strap should be a sufficient length, when fully extended, that the user can carry the bag over his head and support the bag by the opposite shoulder.

A right and left connector system is provided on each side of the traveling bag. Each connector system include releasable mating elements preferably side release male and female mating elements. On each side of the bag, one of the side connector mating elements is preferably affixed to the bag preferably at a point below where the strap is permanently affixed and preferably near the bottom of the bag. On either side of the strap the corresponding mating elements of the right and left side connectors are attached to the strap. A handle is mounted to the strap and positioned along the strap between the mounted right and left side mating elements. A top right connector system and top left connector system are also provided. The top connector systems have mating elements preferably male and female side release connector elements. On the top right of the bag, a mating element of the top right connector system is preferably permanently mounted to the bag. Similarly on the left top of the bag, one of the mating elements of the top left connector is preferably permanently affixed to the bag. The corresponding mating elements of the mounted top left and mounted top right connectors are mounted to the strap. The top right mating element is mounted between the handle and the mating connector associated with the right side connector. Similarly the mating element of the left top connector is mounted between the handle and the mating element of the left side connector.

According to the invention the traveling bag has preferably four modes of operation. These modes are activated by the user engaging or disengaging various combinations of the connectors and making use of the single carrying strap. Thus, the hand carrying mode is activated by engaging the top right and top left connectors so that the handle is supported by the top of the bag through the connectors. In the hand carrying mode, the right and left side connectors are also engaged. In this position, the unneeded portion of the long strap is directed along the body of the bag and out of the way. As a result, the traveling bag can be easily carried by the user with the handle and weight supported by the top of the bag without the danger of the strap slipping.

The back pack mode is activated by engaging the right side and left side connector and pulling the strap toward the back of the bag. The user then can use the traveling bag as a back pack. Optionally the top connectors can be engaged to allow use as either a back pack or hand carrying bag.

The shoulder bag mode is activated by disengaging one of the top connectors and also disengaging the side connector on the same side as the disengaged top connector. The opposite side connector is engaged to hold any slack in the strap neatly along the opposite side of the bag. The user can pull the strap towards the top of the bag. Optionally the handle which is slidably mounted to the bag can be adjusted for easy engagement on the user's shoulder. As a result, the traveling bag can then be easily carried as a shoulder bag.

The over the head mode is activated by disengaging both top connectors and both side connectors. In this configuration the strap is fully extended toward the top of the bag. The user can carry the bag as an over the head bag. As a result, a multimode traveling bag is provided which uses but a single strap and a single handle, but allows the user to carry the bag in four different modes.

The preferred embodiment of the present invention is illustrated in the drawings and description. However, it should be expressly understood that the present invention should not be limited solely to the illustrative embodiment.

DETAILED DESCRIPTION OF THE INVENTION

According to the invention a multimode traveling bag is provided which can be carried as a hand carrying bag, a back pack, shoulder bag or over the head bag. The invention provides these multimode operations while limiting the number of handles and straps. Preferably a single handle and strap are provided which are neatly positioned along the body of the bag when not in use. The traveling bag desirably has a single strap affixed at each end of the strap to the left and right side of the traveling bag. The strap should be of sufficient length so that the attached strap can be placed over the head of the user when the user desires to carry the bag over his head and support the bag by the opposite shoulder.

Figure 1:
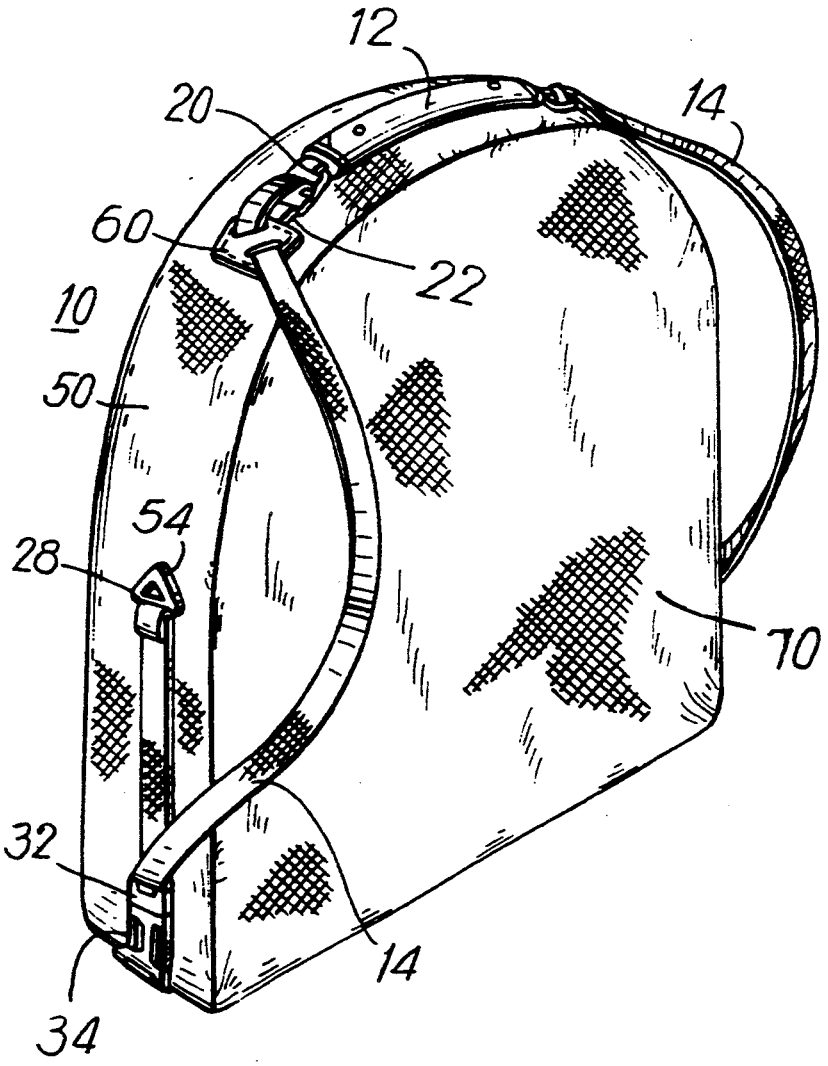
FIG. 1 is a perspective view of the traveling bag according to the invention configured in the hand carrying mode.

Referring now to the drawings, FIG. 1 is a perspective view of the multimode traveling bag according to the invention. As shown in FIG. 1 the bag 10 is configured in the hand carrying mode. However, it should be noted that the traveling bag according to the invention preferably has four modes, that is, a hand carrying mode, a back pack mode, a shoulder bag mode and an over the head mode. According to the invention a traveling bag 10 is provided. A single strap 14 is permanently affixed to the left side 50 of the traveling bag and to the right side 52 of traveling bag 10. Desirably the strap 14 is affixed by an anchor, a belt keeper or loop 54 and 56 which has been securely attached to the bag to allow easy attachment of the strap 14. Desirably the strap is attached at a point approximately half way from the top of traveling bag 10. The strap 14 is of sufficient length so that it will extend above the top of the bag a sufficient distance so that the user will be able to place the strap over his head and support the bag with the opposite shoulder if desired.

A right side connector system and a left side connector system are provided. The left side connector system includes mating elements, preferably side release connector elements 32 and 34. Side release female connector element 34 preferably is permanently attached to left side 50 of traveling bag 10. Desirably the connector element 34 is sewed, glued or otherwise adhered to the bag so that it is securely attached. Preferably the connector element 34 is located near the bottom of the side 50. Male connector 32 which is preferably a side release connector is mounted to the strap 14. Preferably male connector is slidably adjustably mounted to said strap 14 so that it can be positioned along the strap as desired.

Right side connector system includes mating elements, preferably side release connector elements 36, and 38. Female connector element 38 is preferably permanently attached to right side 52 of traveling bag 10. Desirably connector element 38 is sewed, glued or otherwise affixed to the traveling bag 10. Preferably connector element 38 is located near the bottom of side 52. Male connector 36 which is preferably a side release connector is mounted to the strap 14. Preferably male connector 36 is slidably adjustably mounted to said strap so that it can be positioned along the strap as required.

Handle 12 is mounted to the strap 14. Preferably handle 12 is located along strap 14 equadistant from sides 50 and 52. Optionally handle 12 is slidably, adjustably mounted to strap 14. Handle 12 is positioned between left side male connector element 32 and right side male connector element 36.

A top right connector system and a top left connector system are provided at the top of the bag. The right top and left top connector systems have mating connector elements. The connectors interact with the handle and the top of the bag to allow the traveling bag 10 to be carried by the handle. The left top connector system includes female element 22 which is preferably permanently affixed to the top of the bag 10 and male element 20 is preferably slidably mounted to the strap 14 between handle 12 and male connector 32. Similarly the right top connector system includes female element 26 which is preferably permanently affixed to the top of the traveling bag 10. Male element 24 is preferably slidably mounted to the strap 14 between handle 12 and male side connector 36.

Figure 10:
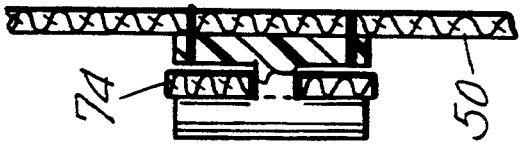
FIG. 10 is a section through 10—10 of FIG. 9.
Figure 9:
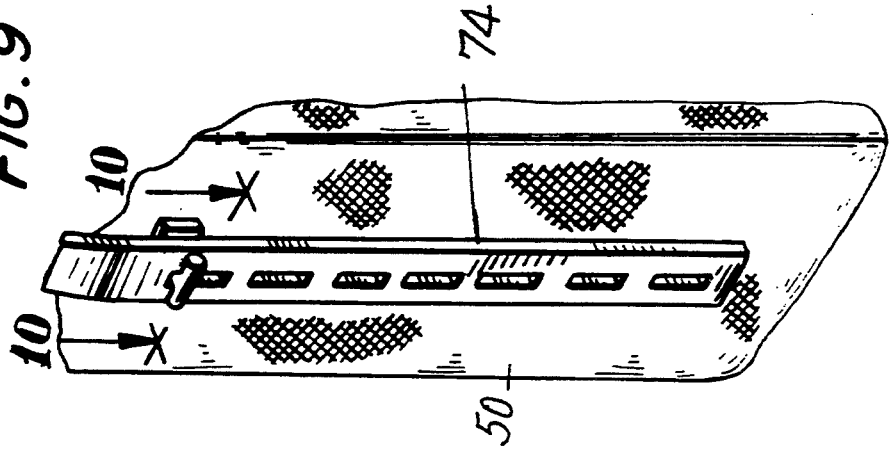
FIG. 9 is a side view of the traveling bag showing an alternative connector system.
Figure 8:
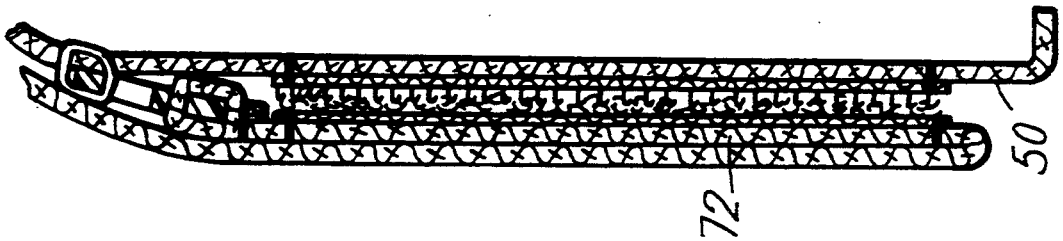
FIG. 8 is a section through 8—8 of FIG. 7.
Figure 7:
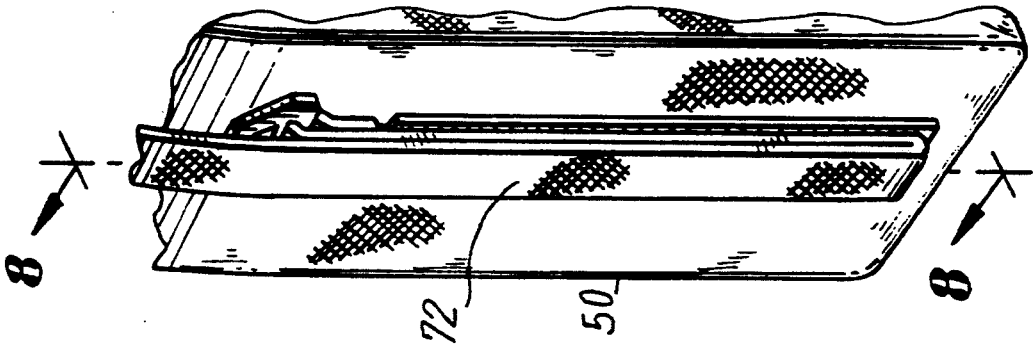
FIG. 7 is a side view of the traveling bag showing an alternative connector system.

It should be noted that any of several connector systems can be used according to the invention, for example as shown in FIGS. 7 to 10. FIGS. 7 and 8 shows a VELCRO, otherwise known as hook and loop fasteners, connector system 72 and FIGS. 9 and 10 show a toggle system 74 that can be alternatively used. Other connector systems may also optionally be employed. According to the invention, the slidably mounted connectors 32, elements 36, 20 and 24 preferably include a conventional strap keeper having a horizontal belt bar which allows the connector to be secured to the strap and also to be moved along the strap as desired. Optionally strap guides 60 and 62 are permanently affixed to right and left side of the top of the bag 10 and receive and direct strap 14 angularly toward the back 70 of the bag in back pack and the hand carrying mode. As shown in FIG. 1, preferably the strap 14 is directed toward the back of the bag on both sides of the handle at an acute angle to the rear face of the traveling bag 10 preferably at a 30° to 60° angle and most preferably at a 45° angle to form a back pack arm loop. The guides 60 and 62 also act as stops to prevent movement of the handle 12 too far down the side of the traveling bag 10.

According to the invention, the traveling bag 10 has four modes of operations. These modes are activated by the user by engaging or disengaging various combinations of the connectors. In the hand carrying mode as shown in FIG. 1, the top right connector system is engaged by connecting male and female connector elements 24 and 26 and top left connector system is engaged by connecting male and female connector elements 20 and 22. Left side connector system and right side connector system are engaged by connecting female element 34 with male element 32 and female element 38 with male element 36. Strap 14 will be directed toward the back 70 of the bag 10 through strap guides 60 and 62, thereby reducing the possibility that a loose strap might be caught in a projecting object or an escalator or the like. The handle 12 is supported by the top of the bag through top right and top left connectors system. The resulting traveling bag can be easily carried as a hand carrying bag.

The back pack mode of the traveling bag 10 is activated by engaging the right side connector system and the left side connector system. The strap 14 is directed toward the back of the bag to form back pack loops. Optionally as shown in FIG. 1, the right top connector 23 and the left top connector 19 can be engaged in the back pack mode particularly if the user desires to switch back and forth between hand carrying the back and a back pack.

Figure 3:
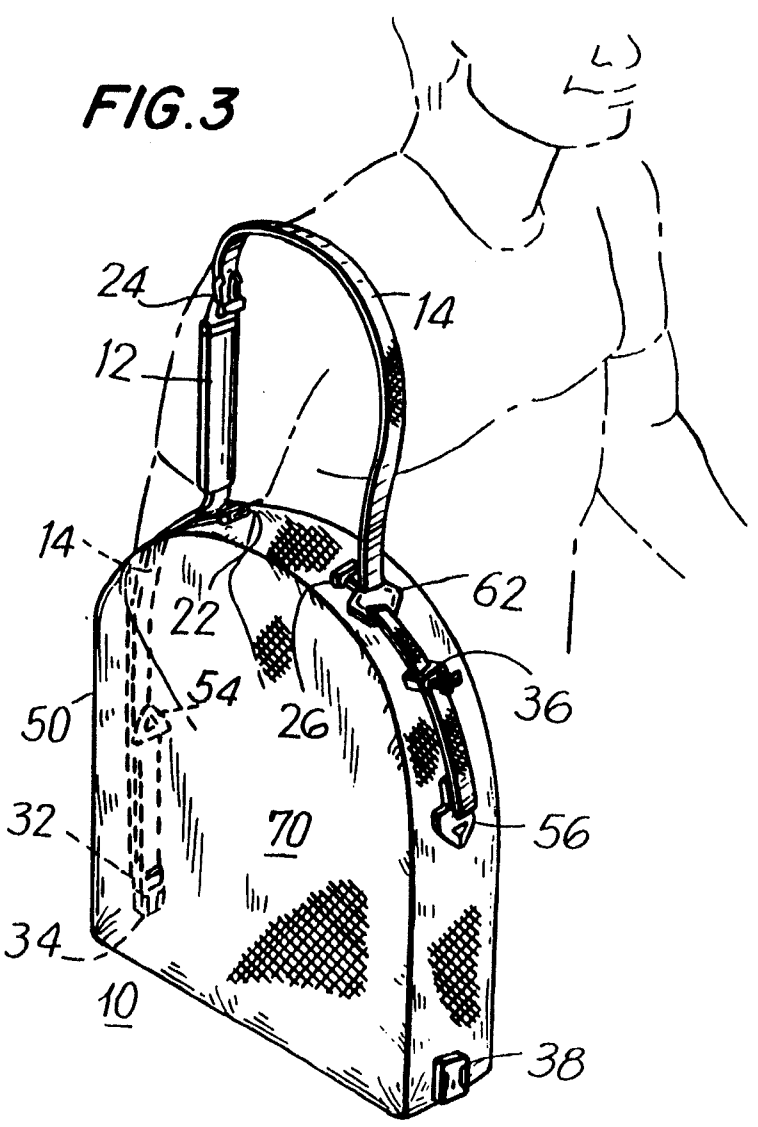
FIG. 3 is a perspective view of the traveling bag of FIG. 1 configured in the over the shoulder mode.

The shoulder bag mode is best seen by referring to FIG. 3. According to the invention in the shoulder bag mode, a side connector and a top connector on the same side will be disconnected as shown in FIG. 3. Thus, for example male and female elements 24 and 26 of top connector systems are disengaged as are male and female elements of 36 and 38 of the right side connector system. The left side connector system will be engaged by engaging side elements 32 and 34 and top elements 24 and 22. In this mode, any excess slack in strap 14 will be held neatly next to side 50 of bag 10. The user then can carry the traveling bag 10 over one shoulder.

Figure 2:
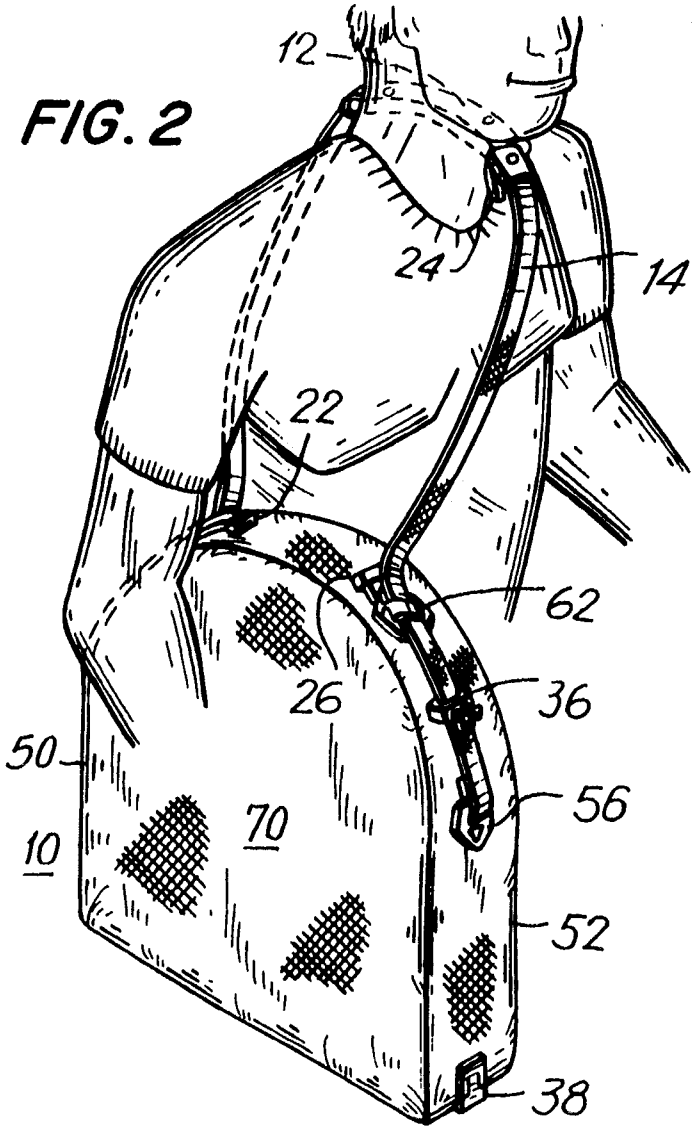
FIG. 2 is a perspective view of the traveling bag of FIG. 1 configured in the over the head mode.

As best seen in FIG. 2, the over the head mode of the traveling bag 10 is activated by disengaging the left and right top connector systems and the left and right side connector systems. This will allow for the maximum length of strap 14 to be pulled toward the top of the bag. In this configuration the user can carry the bag as an over the head bag. As a result, according to the invention a multimode traveling bag is provided which uses but a single strap and a single handle but allows the user to carry the bag in four different modes.

Figure 4:
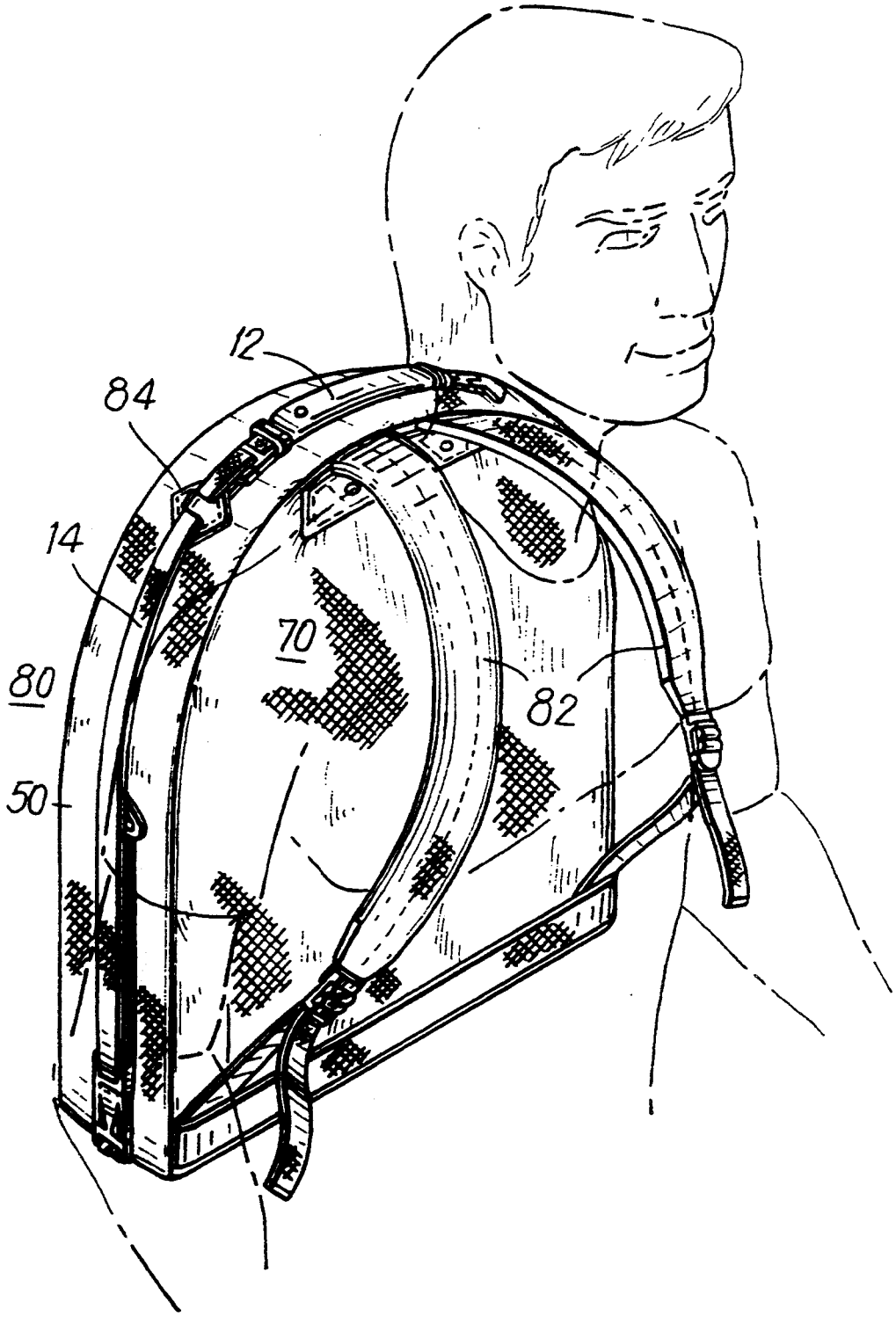
FIG. 4 is a perspective view of an alternative traveling bag according to the invention with permanently attached back pack strap.
Figure 6:
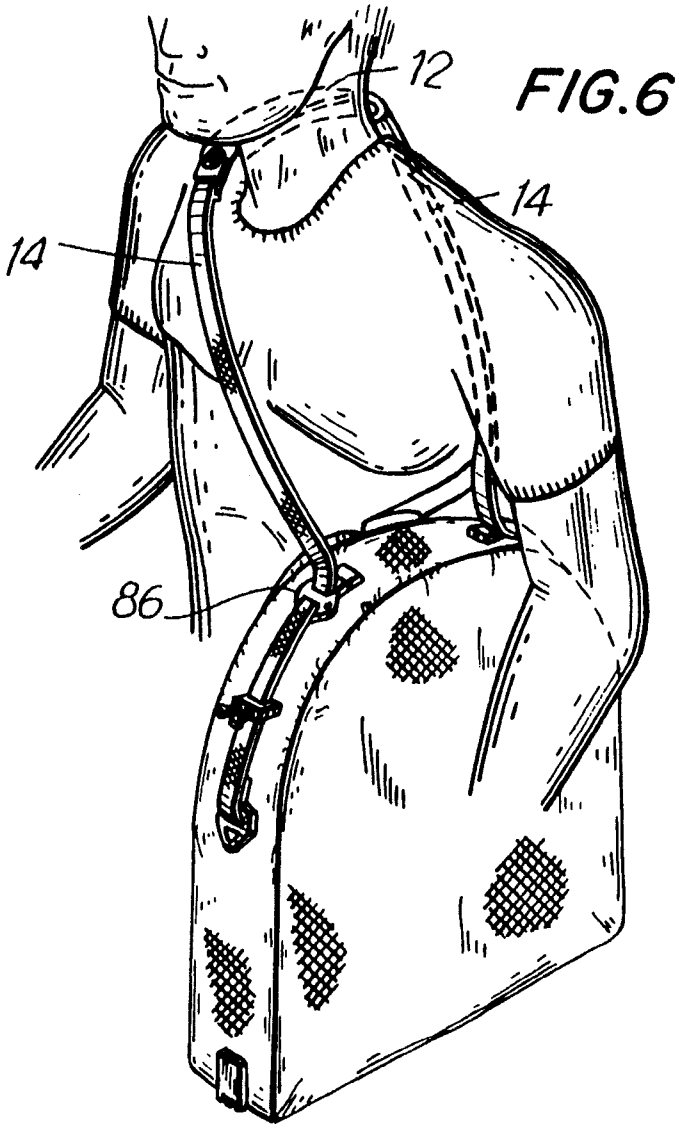
FIG. 6 is a perspective view of the traveling bag of FIG. 4 configured in over the head mode.
Figure 5:
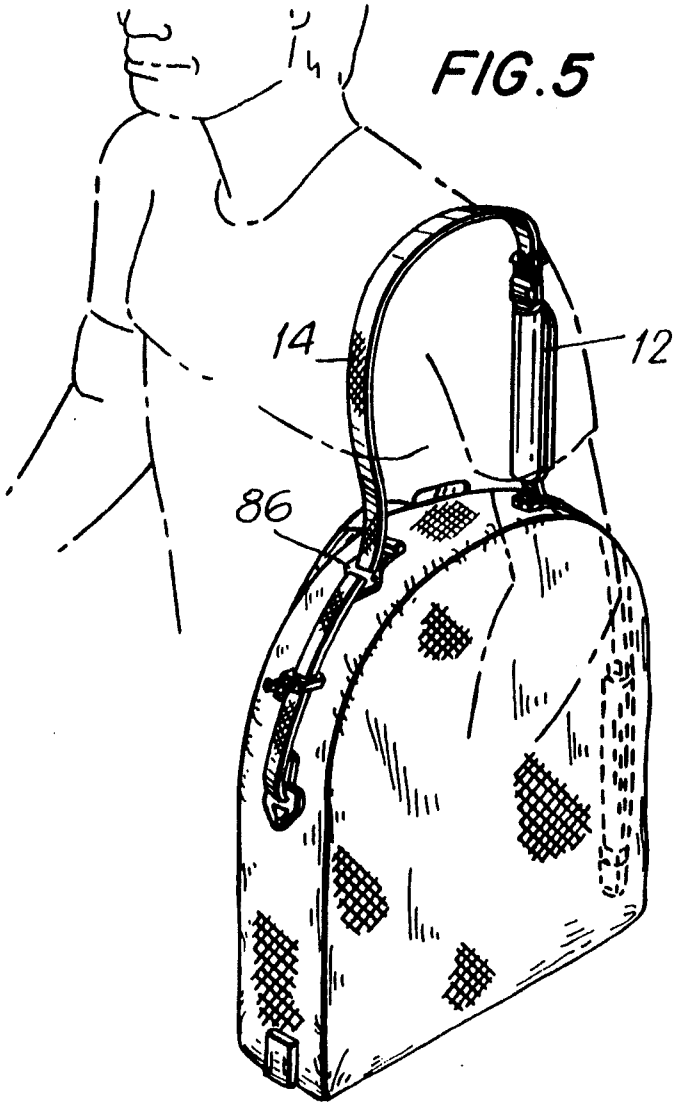
FIG. 5 is a perspective view of the traveling bag of FIG. 4 configured in the over the shoulder mode.

FIGS. 4, 5 and 6 show an alternative embodiment of the invention. In FIGS. 4, 5 and 6 the same parts as shown in FIGS. 1, 2 and 3 are referred to by the same reference numerals. According to the alternative embodiment of the invention, a traveling bag 80 is provided. The bag 80 is preferably adapted for use as a back pack, particularly for heavier loads. However, it does have the alternative modes of use as a hand carrying bag, a shoulder bag or an over the head bag.

Preferably as shown in FIG. 4, heavy duty back pack straps 82 are provided on the back of the bag 80. FIG. 4 shows the bag 80 in the hand carrying mode.

A left guide 84 and a right guide 86 are located at the left and right sides of the top of the bag. The guides 84 and 86 are aligned with handle 12 when the top right and left connector systems are engaged. The guides 84 and 86 receive the strap 14 and guide it directly down the side 50 and 52 of the traveling bag. As a result the strap 14 is neatly directed along the side of the bag to eliminate any play in the strap and to prevent the strap from being caught on projecting objects or the like.

FIG. 5 shows the alternate bag of FIG. 4 in the shoulder carrying mode and is similar to FIG. 3. FIG. 6 is similar to FIG. 2 and shows the alternate bag of FIG. 4 in the over the shoulder mode. It can be seen in FIG. 5 that in the over the shoulder mode the strap 14 is neatly held alongside of the bag.

In FIG. 6 the over the shoulder mode, the maximum length of strap 14 is available for use and allows the user to carry the bag over the shoulder. It should be noted that since there are heavy duty back pack straps permanently attached to the bag, the bag is always available for use as a back pack.

The foregoing is considered as illustrative only to the principles of the invention. Further, since numerous changes and modifications will occur to those skilled in the art, it is not desired to limit the invention to the exact construction and operation shown and described above, and accordingly all suitable modifications and equivalents may be resorted to, falling within the scope of the invention.

I claim:

1. A multimode traveling bag comprising, a top, a left side, a right side, a front, a back and bottom;

a strap affixed at each end thereof to the left side and right side of said bag;

a right side connector composed of a first and second releasable mating elements;

said first mating element permanently affixed to the right side of said bag, below said affixed strap end;

said second mating element adjustably attached to said strap;

a left side connector composed of a third and fourth releasable mating elements;

said third mating element permanently affixed to said left side of said bag, below said affixed strap end;

said fourth mating element adjustably attached to said strap;

a handle mounted to said strap and positioned along said strap intermediate to said second and fourth mating elements;

a top right connector having a fifth and sixth mating element;

said fifth mating element affixed to the top right side of said bag;

said sixth mating element adjustably attached to said strap and located intermediate said handle and said second mating connector;

a top left connector having a seventh and eighth mating element;

said seventh mating element permanently affixed to the top left side of said bag;

said eighth mating element adjustably attached to said strap and located intermediate said handle and said fourth mating connector;

said bag having a hand carrying mode activated by:

engaging said top right and top left connectors so that said handle is supported by the top of said bag whereby said traveling bag can be carried by said handle and the weight of said bag supported by the top of said bag;

and engaging said right side connector and left side connectors whereby said strap is neatly directed along the bag;

said bag having an over the shoulder mode activated by disengaging one of the top connectors and disengaging the side connector on the same side as said disengaged top connector;

engaging the side and top connectors opposite to the disconnected connectors;

whereby the strap can be pulled toward the top of the bag sufficiently so that said bag can be carried as a shoulder bag and any slack in said strap is held neatly along one side of said bag;

said bag having an over the head mode activated by: disengaging both top connectors and both side connectors whereby the maximum length of said strap can be pulled toward the top of the bag and carried as an over the head bag.

2. A multimode traveling bag according to claim 1 wherein in said hand carrying mode, said strap is directed toward the body of said traveling bag on either side of said handle, and further comprising said bag having a back pack mode activated by:

engaging said side connectors and pulling said strap toward the back of said bag to form arm loops on the left and right side of the back of said bag;

whereby said bag can be carried as a back pack.

3. The multimode traveling bag according to claim 2 wherein said top left and top right connectors are side release connectors having a male and female mating element; and said right side and left side connectors are side release connectors having male and female mating elements.

4. The traveling bag according to claim 2 further comprising a stop means located on either side of said handle to limit the movement of said handle along said strap.

5. The traveling bag according to claim 2 wherein said handle is slidably mounted to said strap.

6. A multimode traveling bag according to claim 2 further comprising a right strap guide affixed to the top of said bag and located to the right of said handle;

a left strap guide affixed to the top of said bag and located to the left of said handle;

said right strap guide receiving a portion of said strap and directing said strap toward the body of said bag to the right of said handle in said hand carrying and back pack mode;

said left strap guide receiving a portion of said strap and directing said strap toward the body of said bag to the left of said handle in said hand carrying and back pack mode;

whereby arm loops are formed on the back of said bag for carrying said bag as a back pack.

7. A multimode traveling bag according to claim 6 wherein said strap is directed by said guides toward each side of the back of the bag at an acute angle to the rear face of the back pack.

8. The multimode traveling bag according to claim 7 wherein said acute angle is from 30° to 60°.

9. The multimode traveling bag according to claim 8 wherein said acute angle is about 45°.

10. A multimode traveling bag according to claim 1 wherein in said hand carrying mode said strap is directed down the right and left sides of the traveling bag.

11. The multimode traveling bag according to claim 10 further comprising heavy duty back pack straps securely mounted to the back of said bag.

12. The multimode traveling bag according to claim 11 wherein said top left and top right connectors are side release connectors having male and female mating elements; and said right side and left side connectors are side release connectors having male and female mating elements.

13. The traveling bag according to claim 11 further comprising a stop located on either side of said handle to limit the movement of said handle along said strap.

14. The traveling bag according to claim 11 wherein said handle is slidably mounted to said strap.

15. A multimode traveling bag according to claim 11 further comprising a right strap guide affixed to the top of said bag and located to the right of said handle; and said strap guide aligned with said handle when said top connectors are engaged;

a left strap guide affixed to the top of said bag and located to the left of said handle; said strap guide aligned with said handle when said top connectors are engaged;

each said strap guide receiving a portion of strap and directing said strap toward the side of said bag in said hand carrying mode so that said strap is neatly and securely held along the sides of said bag.

* * * * *